US010617173B2

(12) United States Patent
Twist

(10) Patent No.: US 10,617,173 B2
(45) Date of Patent: Apr. 14, 2020

(54) ACCESSIBLE FOOTWEAR

(71) Applicant: Steve Twist, Newberry, FL (US)

(72) Inventor: Steve Twist, Newberry, FL (US)

( * ) Notice: Subject to any disclaimer, the term of this patent is extended or adjusted under 35 U.S.C. 154(b) by 14 days.

(21) Appl. No.: 16/051,627

(22) Filed: Aug. 1, 2018

(65) Prior Publication Data

US 2020/0037703 A1 Feb. 6, 2020

(51) Int. Cl.

| | |
|---|---|
| ***A43B 11/00*** | (2006.01) |
| ***A43C 11/14*** | (2006.01) |
| ***A43C 11/12*** | (2006.01) |
| ***A43B 3/02*** | (2006.01) |

(52) U.S. Cl.

CPC ..... *A43B 11/00* (2013.01); *A43B 3/02* (2013.01); *A43C 11/12* (2013.01); *A43C 11/1493* (2013.01)

(58) Field of Classification Search

CPC ..... A43B 11/00; A43B 3/02; A43C 11/02; A43C 11/1493; A43C 11/008; A43C 11/12

USPC ..... 36/138, 99, 105

See application file for complete search history.

(56) References Cited

U.S. PATENT DOCUMENTS

| | | | | | |
|---|---|---|---|---|---|
| 1,927,420 | A * | 9/1933 | Sapluk | A43B 3/02 | 36/45 |
| 2,102,265 | A * | 12/1937 | Halberstadt | A43B 3/16 | 36/7.3 |
| 2,261,125 | A * | 11/1941 | McFeely | A43B 3/24 | 36/101 |
| 2,302,596 | A * | 11/1942 | Bigio | A43B 3/24 | 36/101 |
| 3,192,651 | A * | 7/1965 | Smith | A43B 3/24 | 36/105 |
| 7,614,165 | B2 * | 11/2009 | Curry | A43B 1/0081 | 36/101 |
| D666,800 | S * | 9/2012 | Edwards | D2/911 | |
| 2014/0047736 | A1 * | 2/2014 | Lehmkuhler | A43B 11/00 | 36/50.1 |
| 2015/0223554 | A1 | 8/2015 | Ardell et al. | | |

FOREIGN PATENT DOCUMENTS

| | | |
|---|---|---|
| CN | 206760889 | 12/2017 |
| EP | 2762023 | 8/2014 |
| JP | 2006006577 | 1/2006 |
| KR | 1020020082083 | 10/2002 |

* cited by examiner

*Primary Examiner* — Ted Kavanaugh

(57) ABSTRACT

Footwear that opens fully at its back to allow a user to easily slide his or her foot into the footwear. The footwear may particularly be a boot, such as a cowboy boot or a work boot. The footwear may have both a vertical opening and a horizontal opening, allowing the user to place his or her foot into the footwear without bending his or her ankle.

7 Claims, 7 Drawing Sheets

ACCESSIBLE FOOTWEAR

CROSS REFERENCE

Not Applicable.

BACKGROUND OF THE INVENTION

Field of the Invention

This invention relates generally to footwear and more particularly, but not by way of limitation, to footwear, such as a boot, capable of being opened fully at its back, allowing a user to slide his or her foot into the footwear easily.

Description of the Related Art

People with prosthetic feet often have difficulty inserting their foot into footwear, particularly if the ankle of their foot is non-articulating. This is particularly true of boots, where bending the ankle is typically required to place the foot within the boot. For people with such prosthetic feet, wearing boots is often impossible.

People without prosthetic feet but with other medical issues often have difficulty inserting their feet into shoes and, particularly, boots, as well. For example, people with ankle problems who find it difficult to bend their ankle may be unable to inset their foot into a boot.

Based on the foregoing, it is desirable to provide footwear that opens fully at its back to allow the user to slide his or her foot inside without bending his or her ankle.

It is further desirable for such footwear to be a boot, such as a cowboy boot, that would otherwise be inaccessible to someone who cannot bend his or her ankle.

SUMMARY OF THE INVENTION

In general, in a first aspect, the invention relates to footwear, where the footwear has a back and the back has a top and a bottom, the footwear comprising a vertical opening extending from the top of the back to the bottom of the back and at least one horizontal opening extending laterally from the vertical opening at the bottom of the back. The vertical opening may bisect the back of the footwear and the at least one horizontal opening may comprise a right horizontal opening extending laterally to the right and a left horizontal opening extending laterally to the left, such that the back comprises a right flap defined by the vertical opening and the right horizontal opening and a left flap defined by the vertical opening and the left horizontal opening.

The right flap and the left flap may be capable of being folded back to place the footwear in an open position. The right horizontal opening and the left horizontal opening may be sufficiently sized such that a foot may be placed within the footwear through the vertical opening when the footwear is in the open position.

The footwear may further comprise at least one closure device capable of closing the vertical opening and/or at least one closure device capable of closing the at least one horizontal opening. The at least one closure device may be one or more zippers; hook and loop material; one or more snaps; one or more hooks; lacing with eyelets, grommets, D-rings, or lace hooks; or any combination thereof.

The footwear may be a boot such as a cowboy boot or a work boot, a shoe, or any other style of footwear.

Figure 1:
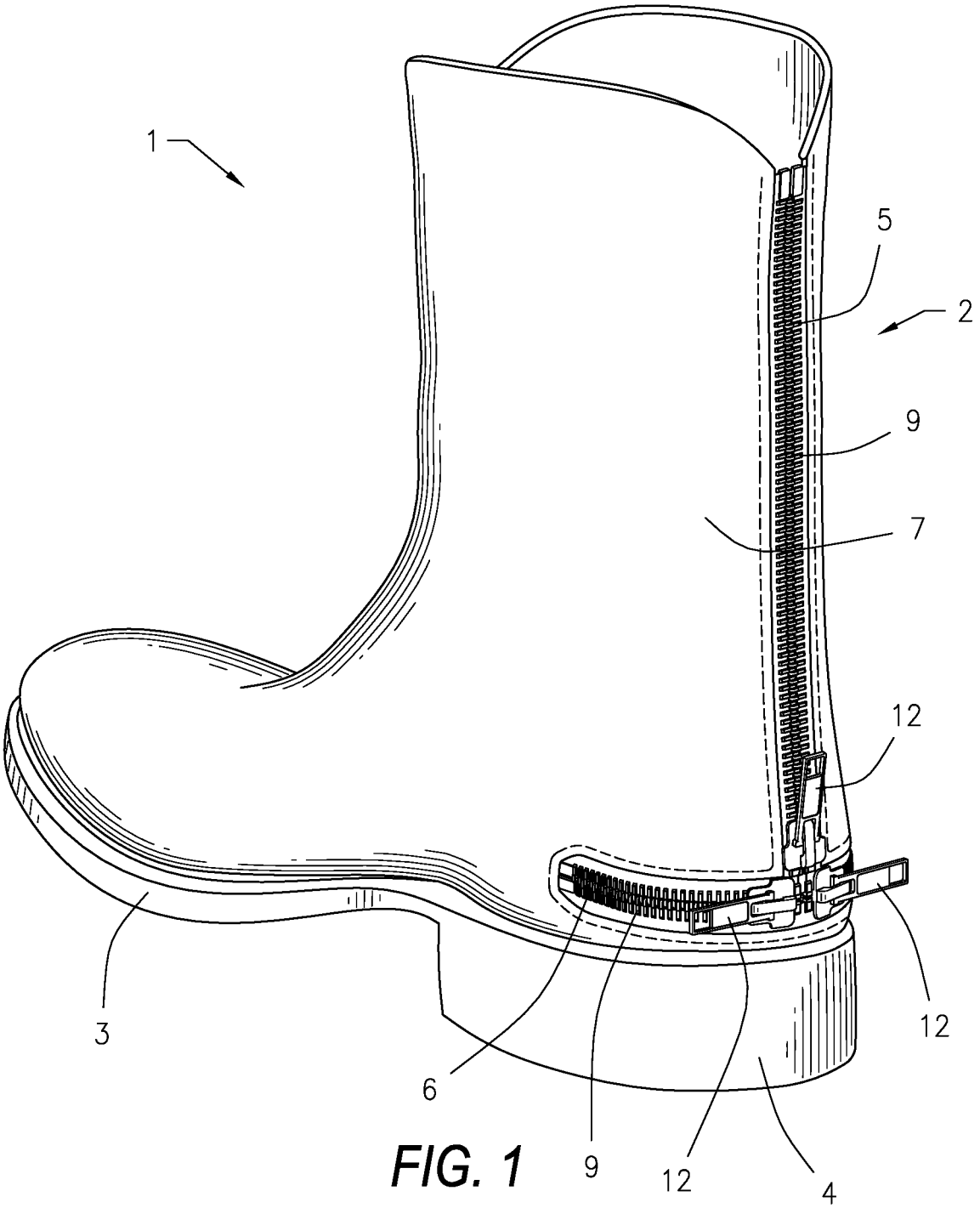
FIG. 1 is a back perspective view of a cowboy boot with rear horizontal and vertical openings, with the boot in a closed position, where the openings are closed via zippers.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to footwear with a fully opening back, allowing the user to slide his or her foot into the footwear without bending his or her ankle.

The footwear 1 may be any style of footwear. For example, the footwear 1 may be a boot, such as a cowboy boot, as shown in FIGS. 1 through 4, or a work boot, as shown in FIGS. 5 and 6, or any other style of boot. Alternately, the footwear 1 may be any other desired style of footwear, with any desired height. The present invention is particularly suitable for boots or other high-topped footwear, such as high tops, that cover the user's ankle, since placing one's foot in such footwear typically requires extensively bending one's ankle. That being said, the present invention is equally applicable to shorter footwear, including shoes that do not cover the ankle. Thus, the footwear 1 may be a boot, as shown, of any style, or may be a shoe of any style or any other type of footwear, including but not limited to cowboy boots, work boots, hiking boots, motorcycle boots, riding boots, rain boots, snow boots, combat boots, Chelsea boots, dress boots, ski boots, booties, ankle boots, chukka, high tops, sneakers, dress shoes, loafers, moccasins, boat shoes, oxfords, brogues, flats, pumps, dance shoes, skates, etc. The footwear 1 may have any desired heel type and heel height and may be made of any desired material.

The footwear 1 may have a back 2 of any desired height. The footwear 1 may have a sole 3 and may have a heel 4, which may be separate from or incorporated into the sole 3. The back 2 of the footwear 1 may have a vertical opening 5 extending from the bottom of the back 2 to the top of the back 2. The back 2 of the footwear 1 may also have one or more horizontal openings 6 located at the bottom of the back 2 and extending toward the sides of the footwear 1. For example, the back 2 of the footwear 1 may have two horizontal openings 6, as shown in the Figures: one extending from the vertical opening 5 to the right and the other extending from the vertical opening 5 to the left. The horizontal openings 6 may be located adjacent the sole 3 and/or heel 4.

Figure 2:
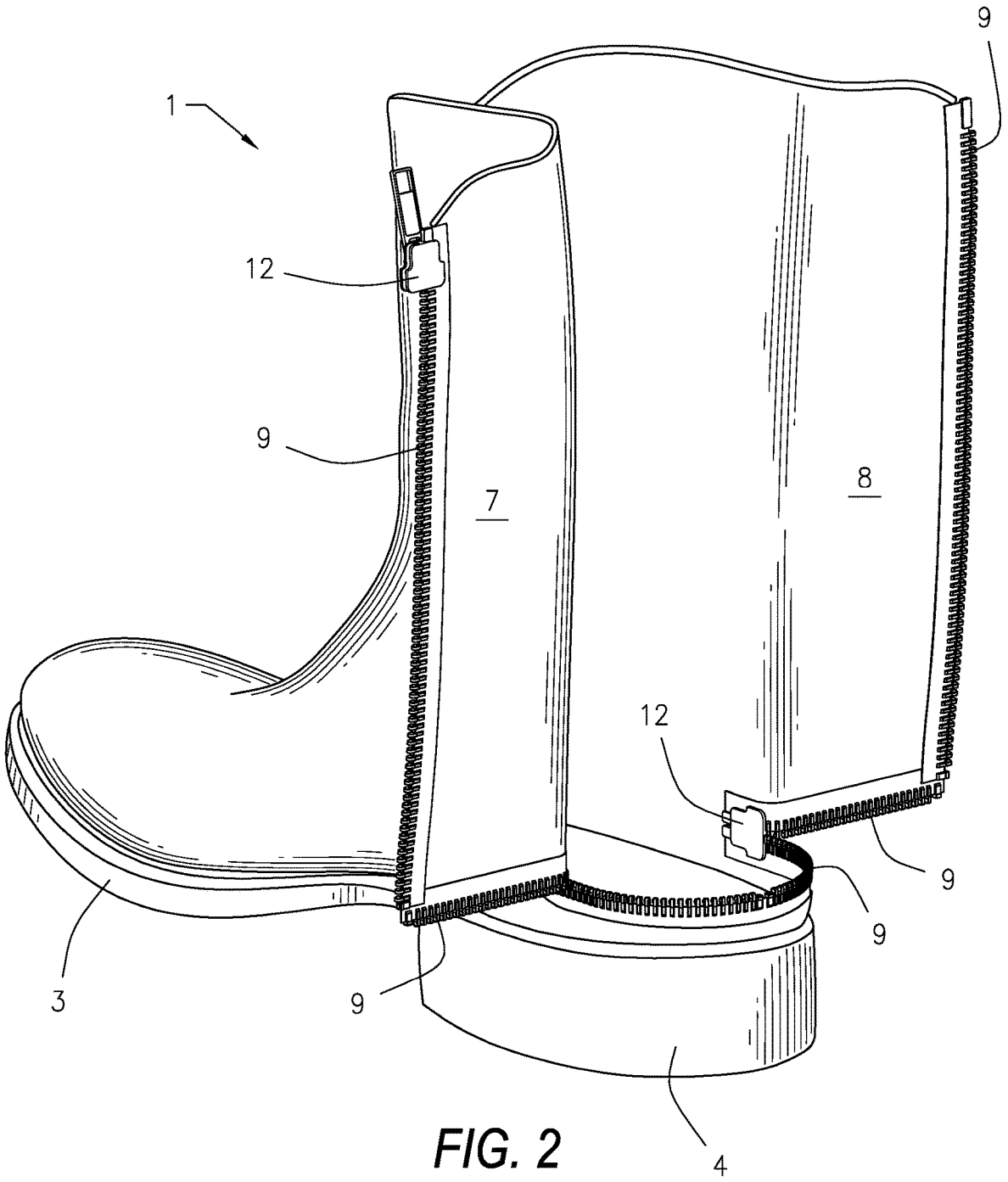
FIG. 2 is a back perspective view of the boot of FIG. 1, with the boot in an open position.
Figure 3:
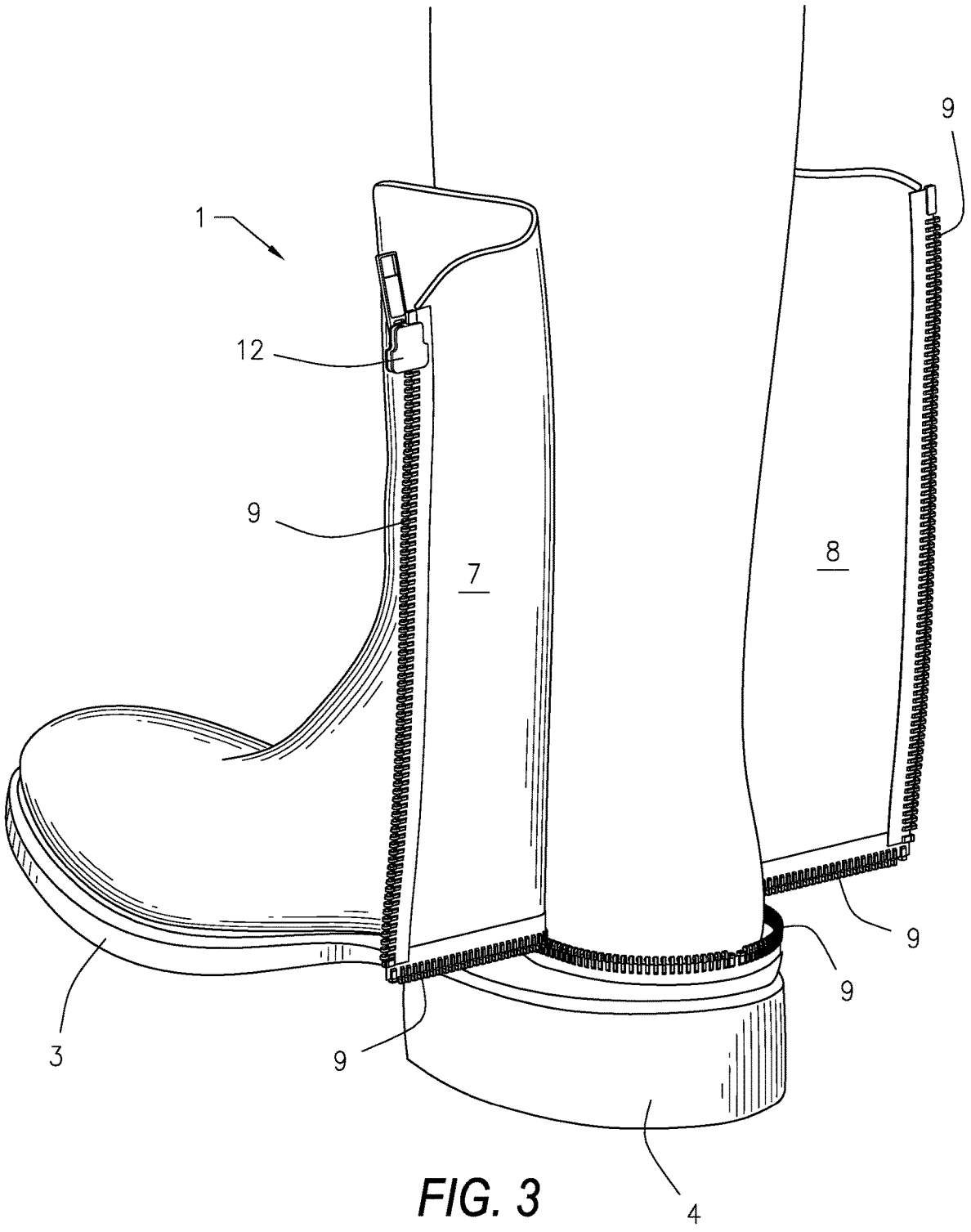
FIG. 3 is a back perspective view of the boot in an open position with a foot therein.

The vertical opening 5 and horizontal openings 6 may allow the back 2 of the footwear 1 to be opened fully, as shown in FIG. 2. The vertical opening 5 may bisect the back 2 into a left flap 7 and a right flap 8. The vertical opening 5 may extend fully to the top of the back 2 and to the bottom of the back 2, allowing the left flap 7 and the right flap 8 to be folded back into an open position, as seen in FIGS. 2, 3, and 6.

Figure 4:
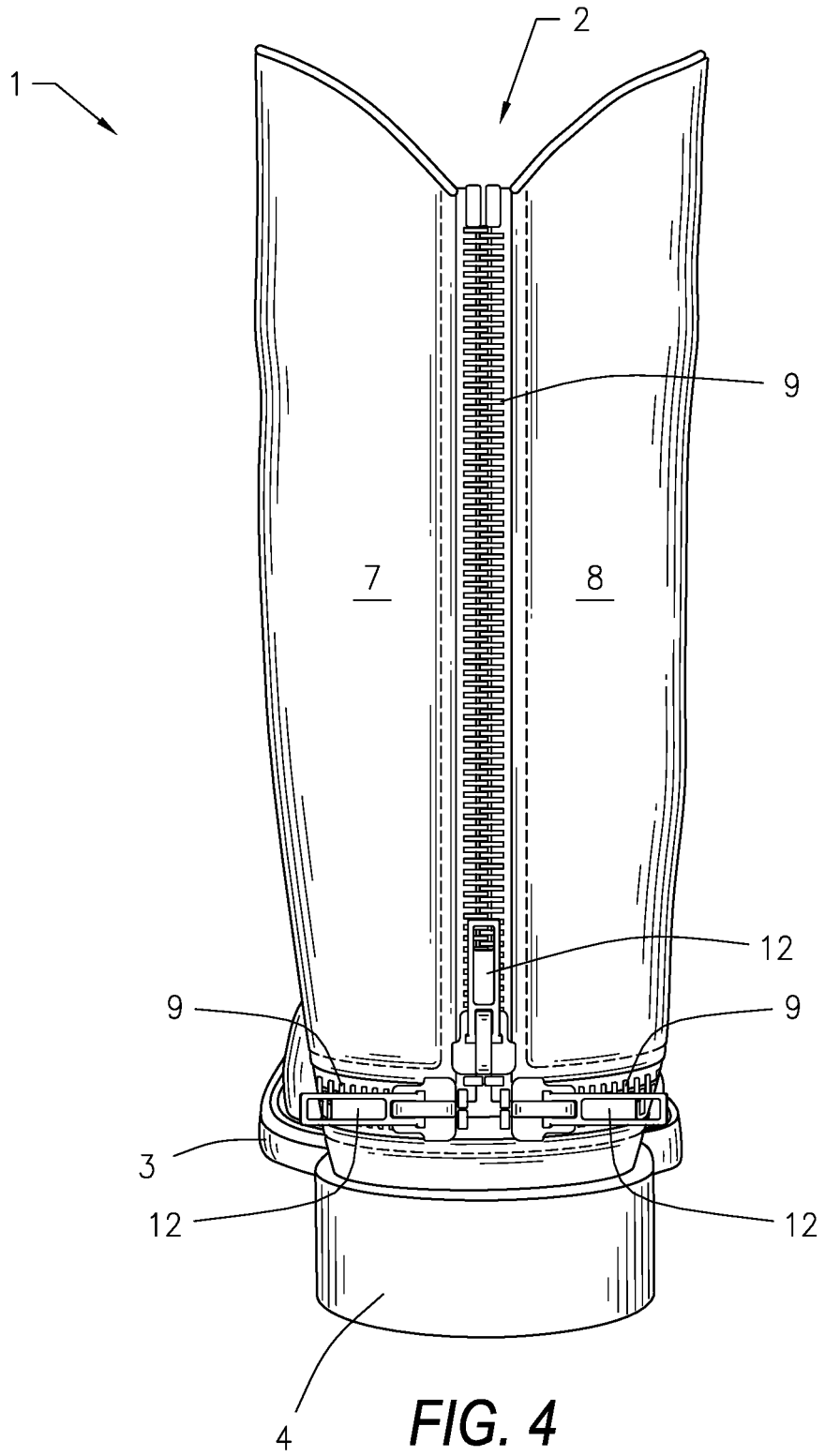
FIG. 4 is a back view of the boot in the closed position.
Figure 5:
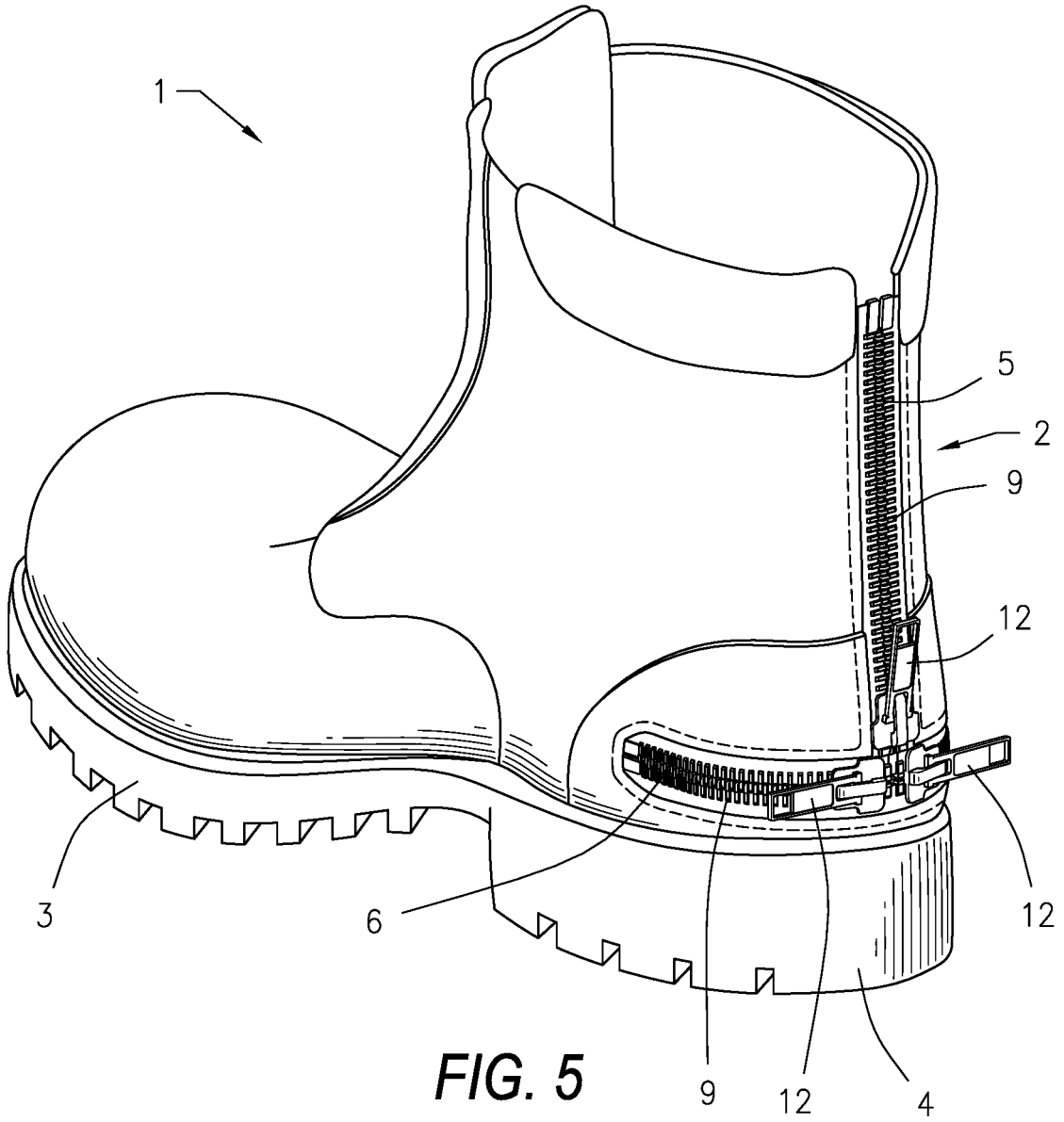
FIG. 5 is a back perspective view of a work boot with rear horizontal and vertical openings, with the boot in a closed position, where the openings are closed via zippers.
Figure 6:
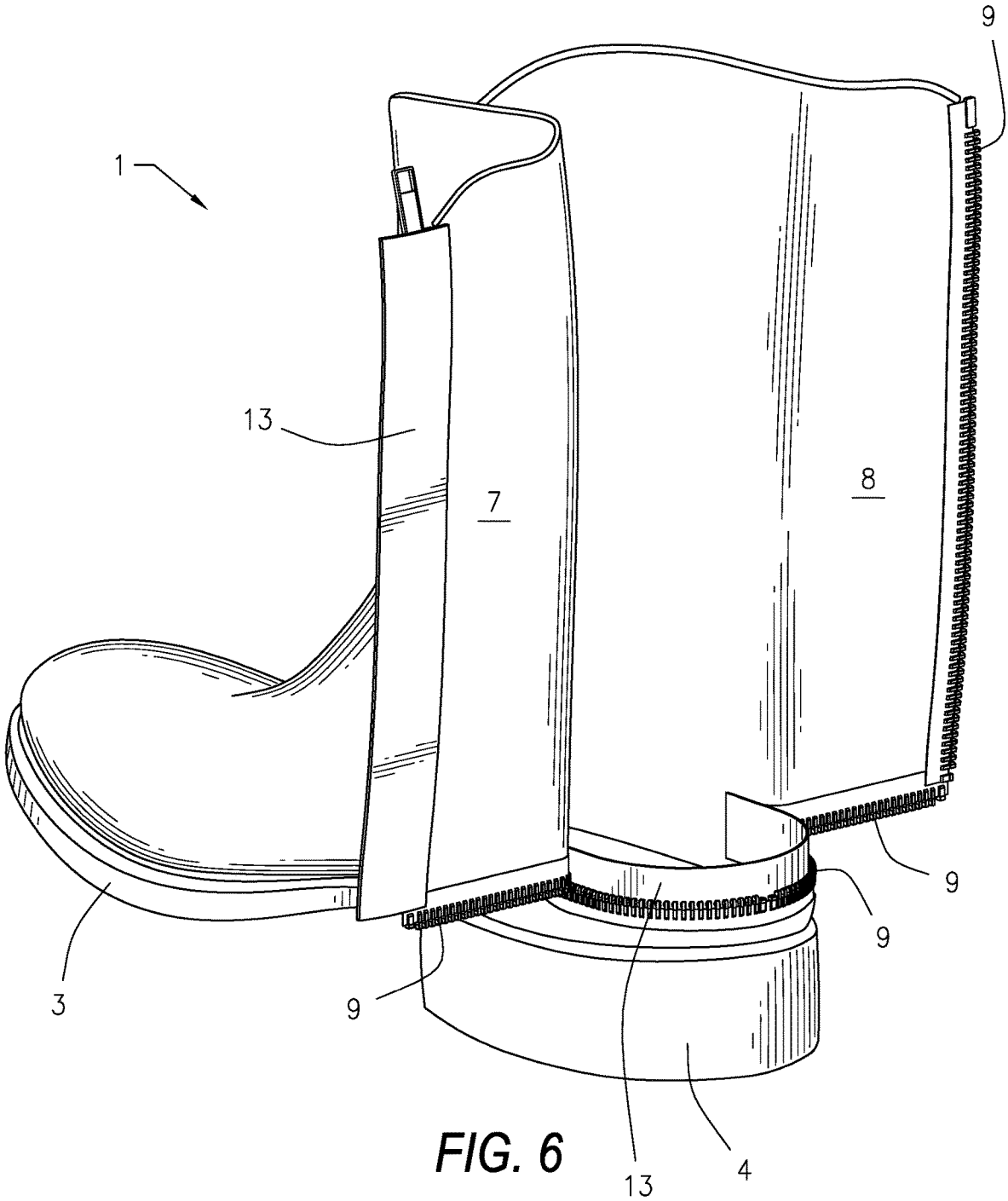
FIG. 6 is a back perspective view of the boot of FIG. 5, with the boot in an open position.
Figure 7:
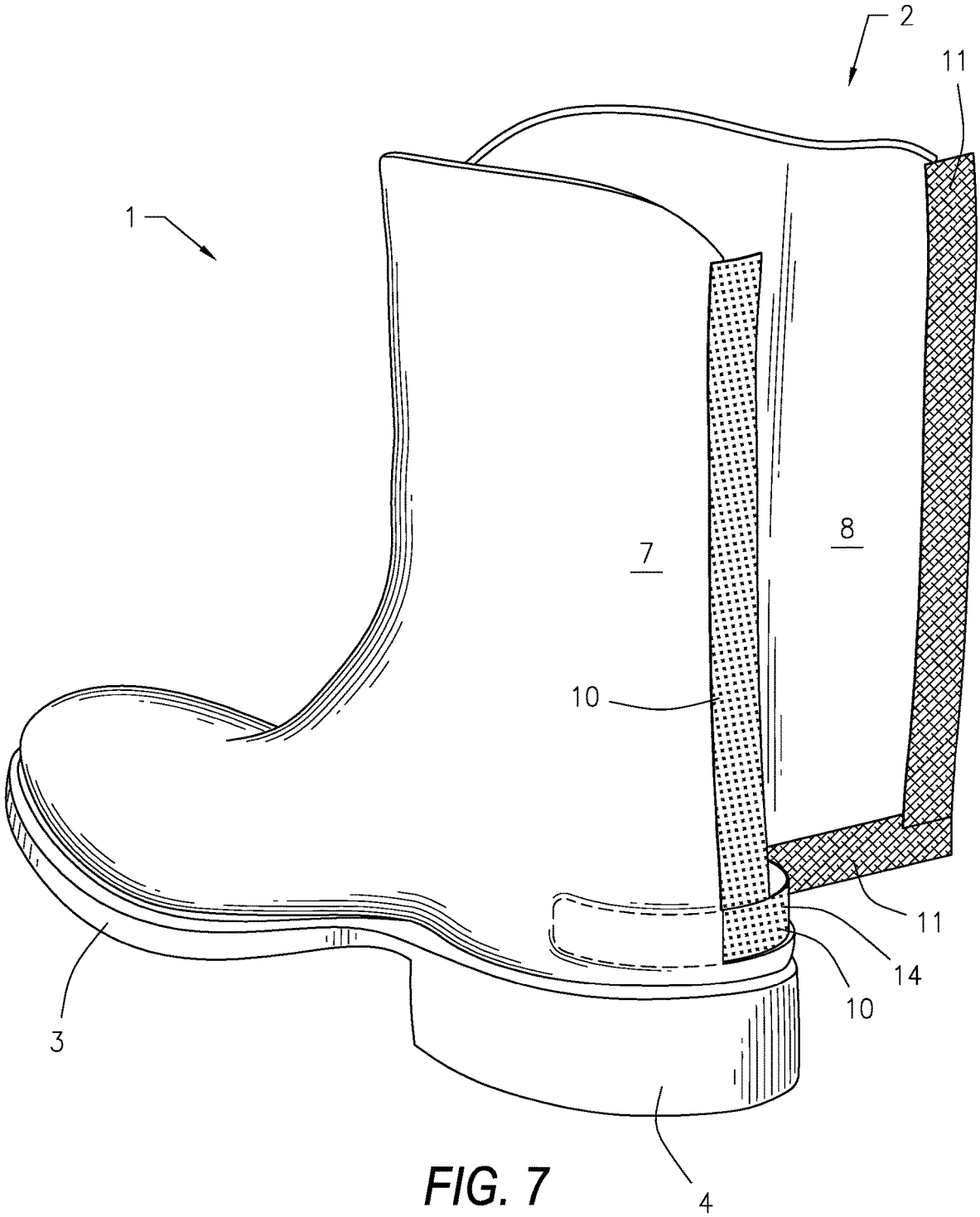
FIG. 7 is back perspective view of a boot with rear horizontal and vertical openings, with the boot in a partially open and partially closed position, where the openings are closed via hook and loop closure.

When in a closed position, as seen in FIGS. 1, 4, and 5, the openings 5 and 6 may be closed with any desired closure device or devices. For example, the openings 5 and 6 may be closed with zippers 9, as shown in FIGS. 1 through 6. Alternately, the openings 5 and 6 may be closed with hook material 10 and loop material 11, as shown in FIG. 7. Alternately, the openings 5 and 6 may be closed with any other desired closure device or combination of closure devices, including but not limited to snaps; hooks; lacing with eyelets, grommets, D-rings, or lace hooks; or any other desired closure device or devices or combination of devices.

If the closure device is zippers 9, as shown in FIGS. 1 through 6, the zipper 9 for the vertical opening 5 may zip from top to bottom, starting at the top from the open position and closing downward so that the zipper pull/slider assembly 12 ends at the bottom when the zipper 9 is fully closed. The zipper 9 for the left horizontal opening 6 may zip from left to right, with the zipper pull/slider assembly 12 located to the left when in the open position and at or near the vertical opening 5 when the zipper 9 is fully closed. Similarly, the zipper 9 for the right horizontal opening 6 may zip from right to left, with the zipper pull/slider assembly 12 located to the right when in the open position and at or near the vertical opening 5 when the zipper 9 is fully closed. When all three zippers 9 are fully closed, all three zipper pull/slider assemblies 12 may be located together at the middle bottom of the back 2. Either the left flap 7 or the right flap 8 may extend past the zipper 9 or may have an additional interior flap 13 extending laterally, as seen in FIG. 6, such that it overlaps the edge of the opposing flap 7 or 8 when the zipper 9 is closed, protecting the user's skin from the zipper 9 during use. An interior flap 13 may additionally or alternately extend upward from the bottom of the back, adjacent the sole 3 above the heel 4, protecting the user's skin from the zipper 9 during use. The zipper pull/slider assemblies 12 may be locking zipper pull/slider assemblies.

If the closure device is hook and loop material 10 and 11, as shown in FIG. 7, the edge of the left flap 7 may overlap the edge of the right flap 8, with hook material 10 on the exterior of the overlapping portion of the left flap 7 and loop material 11 on the interior of the overlapping portion of the right flap 8 such that the hook material 10 can be secured against the loop material 11 when in the closed position. Alternately, hook material 10 may be located on the exterior of the overlapping portion of the right flap 8 and loop material 11 may be located on the interior of the overlapping portion of the left flap 7. A tab 14 of exteriorly oriented hook material 10 may extend upward from the bottom of the back, adjacent the sole 3 above the heel 4. The interior of the bottom edges of flaps 7 and 8 may have loop material 11, such that the hook material 10 of the tab 14 may be secured against the loop material 11 on the bottom edges of flaps 7 and 8 when in the closed position. Alternately, the positions of the hook material 10 and the loop material 11 may be reversed.

During use, the user may open all closure devices, folding back flaps 7 and 8 to place the footwear 1 in the open position. The user may slide his or her foot into the footwear 1 without the necessity of bending the user's foot or ankle. The user may then close the flaps 7 and 8, securing all closure devices, to place the footwear 1 in the closed position for use. The user may reverse the process to remove the footwear 1 from the user's foot.

Whereas, the devices and methods have been described in relation to the drawings and claims, it should be understood that other and further modifications, apart from those shown or suggested herein, may be made within the spirit and scope of this invention.

What is claimed is:

1. Footwear, where the footwear has a back and the back has a top and a bottom, the footwear comprising:

a vertical opening extending from the top of the back to the bottom of the back, where the vertical opening bisects the back of the footwear; and at least one horizontal opening extending laterally from the vertical opening at the bottom of the back, where the at least one horizontal opening extends only partway around the footwear and where the at least one horizontal opening comprises a right horizontal opening extending laterally to the right and a left horizontal opening extending laterally to the left;

such that the back comprises a right flap defined by the vertical opening and the right horizontal opening and a left flap defined by the vertical opening and the left horizontal opening, where the right horizontal opening connects to the left horizontal opening only at the vertical opening.

2. The footwear of claim 1 where the right flap and the left flap are capable of being folded back to place the footwear in an open position.

3. The footwear of claim 1 further comprising at least one closure device capable of closing the vertical opening.

4. The footwear of claim 3 further comprising at least one closure device capable of closing the at least one horizontal openings.

5. The footwear of claim 3 where the at least one closure device is a zipper.

6. The footwear of claim 3 where the at least one closure device is hook and loop material.

7. The footwear of claim 3 where the at least one closure device is one or more zippers; hook and loop material; one or more snaps; one or more hooks; lacing with eyelets, grommets, D-rings, or lace hooks; or any combination thereof.

* * * * *